US012403559B2

(12) United States Patent
Azpeitia et al.

(10) Patent No.: US 12,403,559 B2
(45) Date of Patent: Sep. 2, 2025

(54) MACHINE TOOL FOR GRINDING DISCS

(71) Applicant: DANOBAT S. COOP, Elgoibar (ES)

(72) Inventors: David Barrenechea Azpeitia, Elgoibar (ES); Luis Conde Decimavilla, Elgoibar (ES)

(73) Assignee: DANOBOT S. COOP, Elgoibar (ES)

( * ) Notice: Subject to any disclaimer, the term of this patent is extended or adjusted under 35 U.S.C. 154(b) by 539 days.

(21) Appl. No.: 17/818,029

(22) Filed: Aug. 8, 2022

(65) Prior Publication Data

US 2023/0038909 A1 Feb. 9, 2023

(30) Foreign Application Priority Data

Aug. 9, 2021 (EP) ..... 21382752

(51) Int. Cl.
*B24B 27/00* (2006.01)
*B24B 7/17* (2006.01)

(52) U.S. Cl.
CPC ..... *B24B 27/0076* (2013.01); *B24B 7/17* (2013.01)

(58) Field of Classification Search
CPC ... B24B 7/17; B24B 27/0038; B24B 27/0061; B24B 27/0076; B24B 37/08
USPC ..... 451/190
See application file for complete search history.

(56) References Cited

U.S. PATENT DOCUMENTS

| | | | | |
|---|---|---|---|---|
| 2,122,978 A * | 7/1938 | Eldridge | B24B 7/17 451/210 | |
| 5,820,446 A * | 10/1998 | Lu | G11B 5/84 451/63 | |

FOREIGN PATENT DOCUMENTS

| | | | |
|---|---|---|---|
| DE | 102011117819 A1 * | 5/2013 | B24B 41/02 |
| DE | 102016118270 | 3/2018 | |
| DE | 102019128522 | 4/2021 | |
| EP | 0503491 | 9/1992 | |
| EP | 0730512 | 9/1996 | |
| EP | 0768147 A1 * | 4/1997 | B24B 41/02 |
| GB | 2292329 | 2/1996 | |
| JP | 2015000468 | 1/2015 | |
| WO | WO 94/07653 | 4/1994 | |

OTHER PUBLICATIONS

European Search Report issued in corresponding European Patent Application No. 21382752 dated Feb. 7, 2022.

* cited by examiner

*Primary Examiner* — Brian D Keller
*Assistant Examiner* — Aaron R McConnell
(74) *Attorney, Agent, or Firm* — NORTON ROSE FULBRIGHT US LLP

(57) ABSTRACT

Methods and machine tools for grinding discs. The machine tool comprises two grinding units with respective grinding spindles on which grinding wheels are arranged and a disc unit that comprises a disc spindle on which the disc to be grinded is arranged. The rotation axes of the grinding spindles are perpendicular to the disc spindle rotation axis. The grinding wheels comprise respective grinding surfaces which are perpendicular to the rotation axis of the disc spindle. The grinding surfaces have a width that is equal or greater than the width of the main surfaces of the disc. The two grinding units are configured to simultaneously move relative to the disc unit in an axis that is parallel to the rotation axis of the disc spindle and in opposite directions such that, in use, the grinding surfaces simultaneously contact opposite surfaces of the disc to grind them down.

18 Claims, 4 Drawing Sheets

MACHINE TOOL FOR GRINDING DISCS

CROSS REFERENCE TO RELATED APPLICATIONS

The present application claims the benefit of priority under 35 U.S.C. § 119 of European Patent Application No. 21382752.0 filed Aug. 9, 2021. The content of the referenced application is incorporated into the present application by reference in its entirety.

TECHNICAL FIELD

In general, the present invention relates to the field of machine tools, and more particularly, to machine tools which have been designed for grinding discs, e.g., brake discs or other pieces with similar geometries, such as circular knives or circular rotary blades, having a high degree of hardness. These discs may be integrally made of hard materials or more preferably, they may be coated with hard materials. The machine tool comprises a disc unit on which the disc to be grinded is to be arranged and two grinding units for simultaneously grinding both main surfaces of the disc. The two grinding units move tangentially and in opposite directions relative to the disc unit to carry out the grinding process.

STATE OF THE ART

Discs are conventionally used in many industrial processes and common applications. These discs may be made of different metals or metal alloys, for example, iron, steel, etc., or may be also made of composite materials such as reinforced carbon-carbon or ceramic matrix composites. For example, the discs may be brake discs for being installed in means of transport such as vehicles or trains, circular knives, circular rotary blades or any other disc-shaped piece designed for industrial or domestic applications. These discs may be also made of or may be coated (hard-coated) with materials with a high degree of hardness to improve their resistance to corrosion and to high temperatures, to increase their mechanical strength, etc.

For the particular case of the brake discs, wear and tear of cast iron brake discs generate higher amounts of brake dust than hard-coated brake discs. Brake dust is mainly made up of iron particles and is caused by the grinding of the cast iron brake disc caused by the brake pads. According to studies, brake dust is up to a 55% of total mass of particles amongst non-exhaust road traffic emissions in urban environments. Thus, the most recent environmental restrictions and higher requirements for wear and corrosion resistance of the brake discs are leading the automotive industry to the replacement of the conventional cast iron brake discs with the hard-coated brake discs.

The hard-coated brake discs offer several advantages over conventional cast iron brake discs. For example, hard-coated brake discs offer improved brake response, high thermal stability, high abrasion resistance, and longer life. They are also more resistant to deformation or warping at high temperatures and, unlike cast iron brakes, do not corrode even when in contact with water or salt during the winter seasons. Besides, as they have higher mechanical resistance the amount of brake dust they emit is significantly lower than conventional cast iron brake discs.

Resurfacing discs is a well-known technique for extending their operational life. Discs are turned or machined, grinding down their surfaces to make them smooth and even so there is very little wear. However, existing solutions for grinding discs made of hard materials or hard-coated discs present complex designs, low productivity rates and allow grinding one single disc per operational cycle of the grinding tool. Moreover, these existing solutions generate extremely high temperatures on the grinded surfaces of the discs during grinding operations that may damage said surfaces and may leave contouring marks that may affect to their performance. For example, in the case of grinding braking discs the contouring marks may reduce the braking capacity of the resurfaced brake discs. Besides, for the hard-coated discs the elevated temperatures reached during the resurfacing operation may also provoke the detachment of the coating from the core of the disc.

Therefore, there is a need in the state of the art for a machine tool for grinding discs, in particular hard-coated discs, that presents a simpler design, provides higher productivity and efficiency rates, that is able to maintain the temperature reached by the disc during the grinding operation within a range that is low enough to ensure that no damages are produced on their main surfaces and that does not leave contouring marks on said main surfaces.

DESCRIPTION OF THE INVENTION

A first object of the invention is a machine tool for grinding discs. The machine tool comprises a first grinding unit and a second grinding unit. The first grinding unit comprises a first grinding spindle having at least one first grinding wheel arranged thereon and a first motor assembly to rotatably actuate the first grinding spindle. The second grinding unit comprises a second grinding spindle having at least one second grinding wheel arranged thereon and a second motor assembly to rotatably actuate the second grinding spindle. The first and second grinding wheels may be made of different abrasive materials, such as diamond (C), cubic boron nitride (cBN), silicon carbide (SiC), etc. In turn, the first and second motor assemblies may be formed by direct spindle motors or AC motors with pulley or gear transmission and means for attaching the grinding units to the surface on which they are to be mounted.

The machine tool further comprises at least one disc unit having a disc spindle on which the disc to be grinded is to be arranged and a third motor assembly for rotatably actuating the disc spindle. The third motor assembly may be formed by servomotors to actuate the disc spindle and means for attaching the disc unit to the surface on which it is mounted. The rotation axes of the two grinding spindles are substantially perpendicular to the rotation axis of the disc spindle.

The discs may be any disc-shaped piece, whether these discs are new or they are not and their main surfaces are subjected to wear and tear, that need to be resurfaced. As used herein, the term "disc" generally refers to any disc-shaped piece, in other words, to any piece having a substantially thin circular geometry with two main surfaces. These main surfaces are preferably planar surfaces which are perpendicular to the axis of the disc although they may have other geometries. The discs may incorporate hubs, cutting teeth, contact surfaces, etc., may have different dimensions and may be made of different materials depending on the application for which they have been designed. They may have been designed for applications in which they rotate around its rotation axis or for being fixed. For example, the discs may be brake discs for conventional vehicles, light, medium or heavy-duty vehicles, trains, or any other means of transport, circular knives, circular rotary blades or any other disc-shaped piece designed for industrial or domestic applications.

As used herein, the term "hard material" refers to materials with a hardness higher than 750 HV (Vickers). Similarly, the expression "hard-coated discs" refers to discs formed by a core, that may be made of cast-iron or other materials, and whose main surfaces are coated with a layer of hard material (hardness higher than 750 HV) such as Tungsten carbide-based surface coatings and new generation metallic materials (Ni, Co or Fe based alloys, able to protect the disc against corrosion and high temperatures of the braking process) plus cost efficient and ecological ceramic phase (VC, TiC, SiC, $Al_2O_3$) that improves the wear resistance of such coatings. In some examples, the layers of hard material can be deposited on the main surfaces of the core using techniques such as laser material deposition or high-velocity oxygen fuel (HVOF) deposition, among many other technologies for depositing of materials. As used herein, the "main surfaces" of the disc are those surfaces subjected to wear and tear which are susceptible of being grinded.

The grinding wheels comprise respective grinding surfaces which are substantially perpendicular to the rotation axis of the disc spindle. These grinding surfaces are those surfaces of the grinding wheels that contact the main surfaces of the discs to grind them down. These grinding surfaces will be preferably planar although may have a different geometry depending on the geometry of the surface of the disc to be grinded. The grinding surfaces have a width that is equal or greater than the width of the surface of the disc to be grinded, the width of the surface of the disc to be grinded being measured in a radial direction of the disc. The width of the grinding surfaces may be measured in a direction parallel to the rotation axis of the grinding spindles. The first grinding unit and the second grinding unit are configured to simultaneously move relative to the disc unit in an axis that is parallel to the rotation axis of the disc spindle and in opposite directions such that, in use, the grinding surfaces of the grinding wheels simultaneously contact opposite surfaces of the disc along the entire width of the surface of the disc to be grinded.

The grinding units are displaceable relative to the disc unit in a direction that is perpendicular to the surfaces of the disc to be grinded between an operative position in which the grinding wheels contact the disc to grind it down, and an inoperative position in which the grinding wheels does not contact the disc and they are positioned far away from the disc. The grinding units are preferably located at both sides of the disc unit.

The material removal from the disc by the abrasive grinding wheels is mainly given by the relatively high tangential peripheral speed between the grinding wheels and the disc (the tangential speed ratio between the disc and grinding wheels may range, for example, between 1-30 and 1-180, although these ratios may be also out of these ranges), in combination with the substantially perpendicular movement (feed motion) of the grinding wheels relative to the disc. The tangential material removal mechanism due to the tangential peripheral speed of the grinding wheels relative to the disc reduces the temperature reached on the braking surfaces during grinding operation. Thus, plastic deformations, cracks and wear in the discs are avoided or at least minimized. Besides, by having grinding surfaces whose width is equal or greater than the width of the surface of the disc to be grinded there is no need to move the grinding wheels in a direction that is perpendicular to the rotation axis of the disc spindle during the grinding operation, avoiding creating contouring marks on the main surfaces of the brake disc. The combination of the perpendicular movement of the grinding wheels relative to the disc and the grinding wheels having a width that is equal or greater than the width of the surface of the disc to be grinded reduces the time required to grind the disc.

In some embodiments, the first grinding unit is mounted on a first platform and the second grinding unit is mounted on a second platform, the first and second platforms comprising means for moving the platforms relative to the at least one disc unit in an axis that is parallel to the rotation axis of the disc spindle and in opposite directions, respectively. Preferably, the first platform and the second platform comprise respective ball screw drives or linear motors to move the platforms perpendicularly with respect to the at least one disc unit.

In some embodiments, the at least one disc unit is fixedly mounted on a bench and the first and second platforms are movably mounted on the same bench. In this way, while the disc unit remain fixed, the two platforms move relative to the disc unit.

In some embodiments, the first grinding spindle and the second grinding spindle are configured to rotate in the same direction or in opposite directions.

In some embodiments, the grinding spindles are cantilevered grinding spindles or twin-grip grinding spindles. The cantilevered grinding spindles are preferred when the width of the surface to be grinded is relatively small (e.g., less than 250 mm) while the twin-grip grinding spindles is preferred when the width of the surface to be grinded is great (e.g., greater than 250 mm) since they provide a higher structural rigidity.

In some embodiments, the disc to be grinded is a disc made integrally of a hard material or a hard-coated brake disc. For example, the disc may be coated with Tungsten carbide-based surface coatings and new generation metallic material (Ni, Co or Fe based alloy, able to protect the disc against corrosion and high temperatures of the braking process) plus cost efficient and ecological ceramic phase (VC, TiC, SiC, Al2O3) that improves the wear resistance of such coatings.

Preferably, the disc to be grinded may be selected from a group comprising brake discs, circular knives and circular rotary blades although it may also be any other disc-shaped piece designed for industrial or domestic applications.

In some embodiments, the first grinding unit comprises a first dresser having a first dressing tool. The first dresser is configured to dress the first grinding wheel. In turn, the second grinding unit comprises a second dresser comprising a second dressing tool. The second dresser is configured to dress the second grinding wheel. The dressers are preferably configured to dress the grinding wheels when the grinding units are in their inoperative position, i.e., when the grinding wheels do not contact the disc and are retracted from the disc unit. Alternatively, the dressers may be configured to dress the grinding wheels when the grinding units are in their operative position, i.e., when the grinding wheels are grinding the disc. The dressers may be stationary dressers (e.g., diamond dressers, dressing stones, etc., having a diamond or abrasive stone as dressing tools) or may be rotary dressers (e.g., disc dressers, crushing disc dressers, silicon carbide dressers, etc., having abrasive discs or wheels as dressing tools). These dressers are actuated from time to time in order to clean the grinding surfaces of the grinding wheels from grinding dust, to provide the required geometry and to expose abrasive grains.

Preferably, each one of the dressers comprises first means for moving the dressing tool in a direction perpendicular to the rotation axis of the grinding spindles and towards the grinding surfaces of the grinding wheels and second means for moving the dressing tool in a direction parallel to the rotation axis of the grinding spindles and along the width of the grinding wheel. The first and second means may be any mechanism able to move the dressing tool in both directions. The width of the grinding wheel is measured in a direction parallel to the rotation axis of the grinding spindles on the grinding surface.

In some embodiments, these dressers may be located in correspondence with a plane formed by both grinding wheels rotational axes, behind the grinding wheels and in proximity to the location of said grinding wheels.

In some embodiments, the machine tool comprises a first disc unit comprising a first disc spindle on which a first disc to be grinded is to be arranged and the third motor assembly for rotatably actuating the first disc spindle. The machine tool further comprises a second disc unit comprising a second disc spindle on which a second disc to be grinded is to be arranged and a fourth motor assembly for rotatably actuating the second disc spindle. These third and fourth motor assemblies can be formed by stepper motors and servomotors and means for attaching the grinding units to the surface on which they are to be mounted. In such embodiments, the first grinding unit comprises two grinding wheels arranged on the first grinding spindle and the second grinding unit comprises two grinding wheels arranged on the second grinding spindle such that a first grinding wheel of the first grinding unit is located in correspondence with a first grinding wheels of the second grinding unit to simultaneously grind the first disc and a second grinding wheel of the first grinding unit is located in correspondence with a second grinding wheel of the second grinding unit to simultaneously grind the second disc.

In some embodiments, the machine tool comprises a dresser with a dressing rotary tool, e.g., a disc or wheel, located between the first and second grinding units, the dresser being movable in a direction parallel to the rotation axis of the grinding spindles such that a dressing surface of the dressing rotary tool simultaneously contacts the grinding surfaces of the pairs of grinding wheels of the first and second grinding units located in correspondence to each other. Preferably, the first and second grinding units are configured to firstly move from their inoperative position towards their operative position (until a dressing position that may match their operative position or may be different) and then, the dresser moves in the direction parallel to the rotation axis of the grinding wheels until the dressing surfaces of the dressing disc contact the grinding surfaces of the grinding wheels to dress them down.

A second object of the invention is a method for grinding discs that uses the machine tool previously described. The method comprises the steps of:

- arranging a disc to be grinded in the disc spindle of the disc unit;
- actuating the disc spindle of the disc unit, the first grinding spindle of the first grinding unit and the second grinding spindle of the second grinding unit by the respective motor assemblies;
- simultaneously moving the first grinding unit and the second grinding unit in an axis that is parallel to the rotation axis of the disc spindle and in opposite directions towards the disc until the grinding surfaces of the grinding wheels simultaneously contact opposite surfaces of the disc along the entire width of the surface of the disc. In other words, the grinding units simultaneously move from their inoperative position in which they do not contact the disc to their operative position in which they contact the disc in a direction that is tangential to the main surfaces of the disc;
- simultaneously grinding both surfaces of the disc by the grinding wheels of the first and second grinding units during a predefined period of time (target cycle time). This predefined period of time may depend on a target productivity rate to remove a given amount of material. In turn, this target productivity rate will depend on whether under the current operational conditions, the amount of material to be grinded can be achieved within the predefined dimensional tolerances, surface finish (roughness) and integrity conditions (thermal damage, discolouring, cracks, spalling, etc.) of the disc;
- simultaneously retracting the first grinding unit and the second grinding unit. The grinding units move from their operative position to their inoperative position; and
- removing the disc from the brake spindle of the disc unit.

The steps of arranging and removing the disc on/from the brake disc unit can be performed manually by an operator or automatically by a robotic arm or any other loading/unloading mechanism.

In some embodiments, particularly when the grinding surfaces of the grinding wheels need to be cleaned, smoothed or homogenized, the method comprises the steps of:

- actuating at least one of the first dressing tool and the second dressing tool of the first and second dressers, respectively. This dressing operation may be required in only one of the two grinding wheels or in both. Thus, the dressing operation of the first grinding wheel can be carried by the first dressing tool independently or jointly and severally with the dressing operation of the second grinding wheel by the second dressing tool;
- moving, by the first means, the corresponding dressing tool in a direction perpendicular to the rotation axis of the respective grinding spindle until a dressing surface of the dressing tool contacts the grinding surface of the grinding wheel; and
- moving, by the second means, the dressing tool in a direction parallel to the rotation axis of the grinding spindle and along the width of the grinding wheel to dress its grinding surface, the width of the grinding wheel being measured in a direction parallel to the rotation axis of the grinding spindle on the grinding surface.

In some embodiments, the method comprises the steps of:

- arranging a first disc to be grinded in the first disc spindle of the first disc unit;
- arranging a second disc to be grinded in the second disc spindle of the second disc unit;
- actuating the disc spindles of the disc units, the first grinding spindle of the first grinding unit and the second grinding spindle of the second grinding unit by the respective motor assemblies, wherein the first grinding unit comprises two grinding wheels arranged on the first grinding spindle and the second grinding unit comprises two grinding wheels arranged on the second grinding spindle such that a first grinding wheel of the first grinding unit is located in correspondence with a first grinding wheel of the second grinding unit and a second grinding wheel of the first grinding unit is located in correspondence with a second grinding wheel of the second grinding unit;

simultaneously moving the first grinding unit and the second grinding unit in an axis that is parallel to the rotation axis of the disc spindle and in opposite directions towards the discs until the grinding surfaces of the grinding wheels simultaneously contact opposite surfaces of the discs along the entire width of the surface of the disc;

simultaneously grinding both surfaces of the discs by the grinding wheels of the first and second grinding units during a predefined period of time;

simultaneously retracting the first grinding unit and the second grinding unit; and removing the discs from the disc spindles of the disc units.

The machine tool and the method for grinding discs of the present invention present several advantages over the prior art. The present solution provides a grinding operation that is thermally efficient, is carried out at low-temperature, ensures the mechanical integrity of the disc and guarantees the reaching the required surface finish within the dimensional tolerances of the piece while high productivity rates are obtained. The machine tool presents a simple structure in which the disc remains fixed and only the grinding wheels move in a perpendicular direction. The productivity is maximized by grinding the entire width of the disc in one penetration operation of the grinding wheel. The width of the grinding wheels is large enough to grind discs of different widths. Besides, by simultaneously contacting both surfaces of the disc with the grinding wheels, deflections and loss of productivity that would be generated if the brake disc were grinded only on one side is avoided. The present solution does not leave contouring marks on the main surfaces of the disc. It further allows simultaneously grinding two discs.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out.

The drawings comprise the following figures.

DETAILED DESCRIPTION OF THE INVENTION

Figure 1:
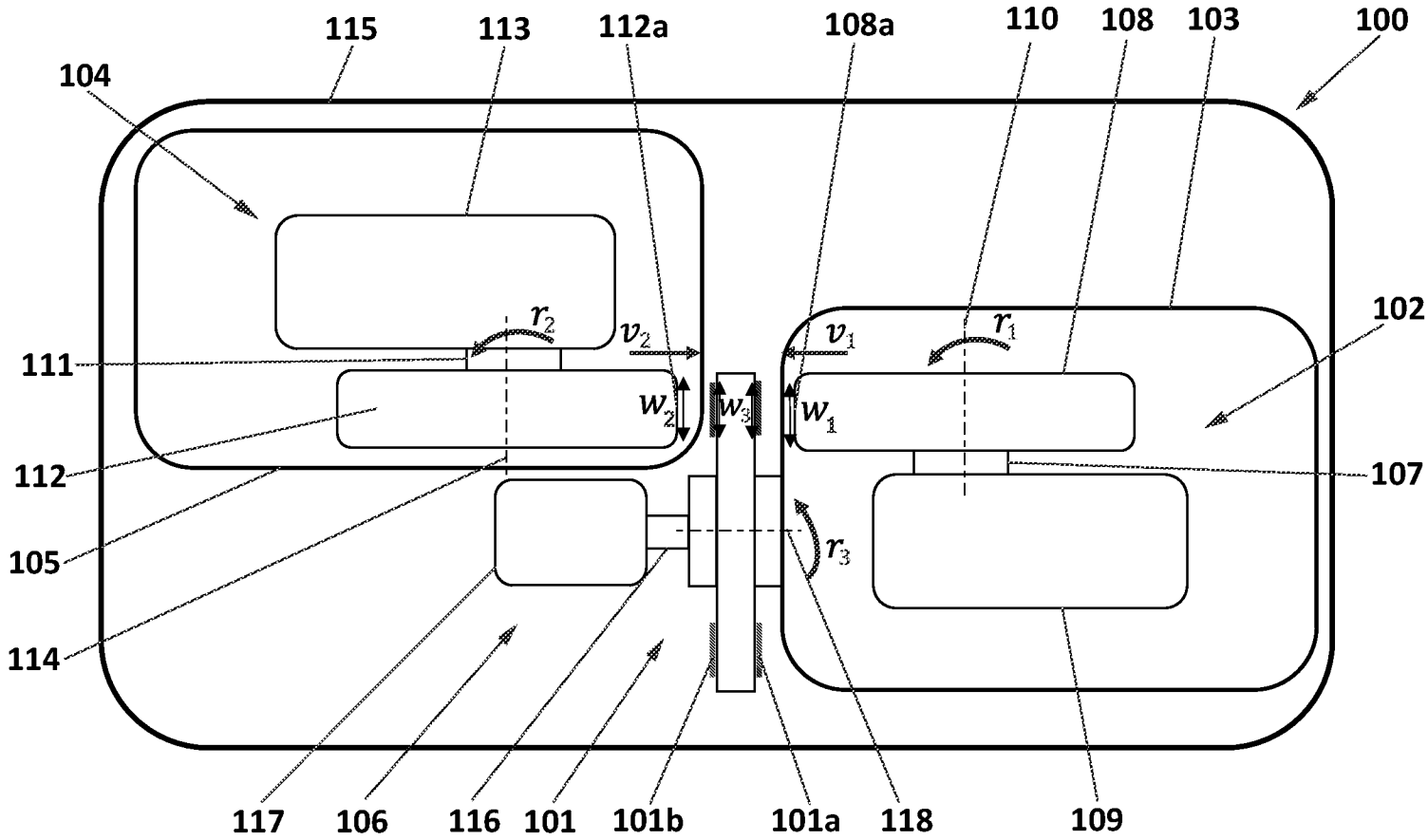
FIG. 1 shows a plant view of a machine tool for grinding a brake disc, according to an embodiment of the invention.

FIG. 1 shows a plant view of a machine tool 100 for grinding a brake disc 101, according to an embodiment of the invention. It should be understood that the machine tool 100 of FIG. 1 may include additional components and that some of the components described herein may be removed and/or modified without departing from a scope of the described machine tool 100. Additionally, implementation of the machine tool 100 is not limited to such embodiment.

The machine tool 100 comprises a first grinding unit 102 mounted on a first platform 103, a second grinding unit 104 mounted on a second platform 105 and a brake disc unit 106 on which the brake disc 101 to be grinded is mounted. The first grinding unit 102 comprises a first grinding spindle 107, a first grinding wheel 108 arranged thereon and a first motor assembly 109 to rotatably actuate the first grinding spindle 107. The first grinding spindle 107 may rotate at a first peripheral speed $r_1$, that for example may range between 100 and 5000 revolutions per minute, around a first rotation axis 110. The second grinding unit 104 comprises a second grinding spindle 111, a second grinding wheel 112 arranged thereon and a second motor assembly 113 to rotatably actuate the second grinding spindle 111. The second grinding spindle 111 may rotate at a second peripheral speed $r_2$, that for example may range between 100 and 5000 revolutions per minute, around a second rotation axis 114. The rotation axes 110,114 of the first and second grinding spindles 107,111 are substantially parallel to each other. Preferably, both grinding wheels 108,112 will rotate in the same direction and with the same peripheral speed although they may rotate in opposite directions and at slightly different peripheral speeds.

The first platform 103 and the second platform 105 are movably mounted on a bench 115 while the brake disc unit 106 is fixedly mounted on said bench 115. For example, the first and second platforms 103,105 may include servomotors actuating ball screws, linear motors, or similar to move both platforms 103,105 in a direction that is substantially perpendicular to the rotation axes 110,114 of the first and second grinding spindles 107,111. The first platform 103 and the second platform 105 will move at a first speed $v_1$ and a second speed $v_2$, respectively, that will be preferably the same speed such that the grinding surfaces 108*a*, 112*a* of the first and second grinding wheels 108 112 simultaneously contact the braking surfaces 101*a-b* of the brake disc 101. The speeds $v_1$ and $v_2$ will vary depending on whether the grinding wheels are contacting the disc or they are not, and may range from 2000 mm/min when the grinding units are moving from their inoperative position to their operative position, to 0.001 mm/min during the grinding operation. By simultaneously contacting both braking surfaces 101*a-b* of the brake disc 101 deflections and loss of productivity that would be generated if the brake disc were grinded only on one side can be avoided.

The first and second grinding wheels 108,112 may be made of different material such as diamond (C), cubic boron nitride (cBN), silicon carbide (SiC), a combination of diamond and cBN, etc. The first and second motor assemblies 109,113 may be formed by direct spindle motors or AC motors with pulley or gear transmission and means for attaching the grinding units 102,104 to the first and second platforms 103,105, respectively. These means for attaching the grinding units 102,104 to the first and second platforms 103,105 may be, for example, a coupling structure that may be an integral part of the motor assemblies 109,113 or being couplable to said motor assemblies 109,113 and that could be welded or screwed to the platforms 103,105.

The brake disc unit 106 also has a brake disc spindle 116 on which the brake disc 101 is arranged and a third motor assembly 117 for rotatably actuating the brake disc spindle 116. The brake disc spindle 113 may rotate at a third rotational speed $r_3$, that for example may range between 1 and 2000 revolutions per minute, around a third rotation axis 118. The third rotational speed $r_3$ may be equal or different to the first and second rotational speeds $r_1$, $r_2$. The third motor assembly 116 may also be formed by a servomotor or stepper motor and means for attaching the brake disc unit 106 to the bench 115. Similarly, these means for attaching the brake disc unit 106 to the bench 115 may be, for example, a coupling structure that may be an integral part of the motor assembly 117 or being couplable to said motor assembly 117 and that could be welded or screwed to the bench 115. The rotation axes 110,114 of the two grinding spindles 108,111 are substantially perpendicular to the rotation axis 118 of the brake disc spindle 116.

The grinding surfaces 108*a*,112*a* of the grinding wheels are substantially planar and perpendicular to the rotation axis 118 of the brake disc spindle 116. These grinding surfaces 108*a*,112*a* have a width $w_1$, $w_2$ that is equal or greater than the width $w_3$ of the braking surfaces 101*a-b* of the brake disc 101. The width of the braking surfaces 101*a-b* is measured in the radial direction of the brake disc 101. In turn, the width of the grinding surfaces 108*a*,112*a* is measured in a direction parallel to the rotation axes 110,114 of the grinding spindles 107,111.

FIG. 1 shows the two grinding units 102,104 in their inoperative position in which the grinding wheels 108,112 does not contact the braking surfaces 101*a-b* of the brake disc 101 and they are positioned far away from it. In use, the platforms 103,105 move relative to the bake disc unit 106 such that the grinding units 102,104 are in their operative position, i.e., the grinding wheels 108,112 displace relative to the brake disc unit 106 in a direction that is perpendicular to the brake disc 101 until the grinding surfaces 108*a*,112*a* contact the respective braking surfaces 101*a-b* along their entire width. The material removal from the brake disc 101 by the abrasive grinding wheels 108,112 is caused by the relatively high tangential peripheral speed between the grinding wheels 108,112 and the brake disc 101, in combination with the relative perpendicular feed motion of the grinding wheels 108,112 relative to the brake disc 10. The tangential material removal mechanism due to the tangential peripheral speed of the grinding wheels 108,112 relative to the brake disc 101 reduces the temperature reached on the braking surfaces 101*a-b* during grinding operation.

Thus, plastic deformations, cracks and wear in the brake discs 101 are avoided or at least minimized. Besides, by having grinding surfaces 108*a*,112*a* whose width $w_1$, $w_2$ is equal or greater than the width $w_3$ of the braking surfaces 101*a-b* of the brake disc 101 there is no need to move the grinding wheels 108,112 in a direction that is perpendicular to the rotation axes 110,114 of the disc spindles 107,111 during the grinding operation, avoiding creating contouring marks on the main surfaces of the brake disc 101 that may worse its braking properties. The combination of the perpendicular movement of the grinding wheels 108,112 relative to the brake disc 101 with the grinding wheels 108,112 having a width $w_1$, $w_2$ that is equal or greater than the width $w_3$ of the surface 101*a-b* of the brake disc 101 to be grinded reduces the time required to grind the braking surfaces 101*a-b* which increases the productivity and efficiency of the resurfacing process. It also avoids creating contouring marks on said braking surfaces 101*a-b* that may worse the braking properties of the disc 101.

The combination of the perpendicular movement of the grinding wheels 108,112 relative to the brake disc 101 with the grinding wheels 108,112 having a width $w_1$, $w_2$ that is equal or greater than the width $w_3$ of the surface 101*a-b* of the brake disc 101 to be grinded reduces the time required to grind the braking surfaces 101*a-b* which reduces the temperature reached in said surfaces 101*a-b* and increases the productivity and efficiency of the resurfacing process.

While FIG. 1 shows the disc unit 106 with a brake disc 101 arranged thereon, another disc-shaped piece such as a circular knife or circular rotary blades may be coupled to the disc spindle 116 of the disc unit 106.

Figure 2:
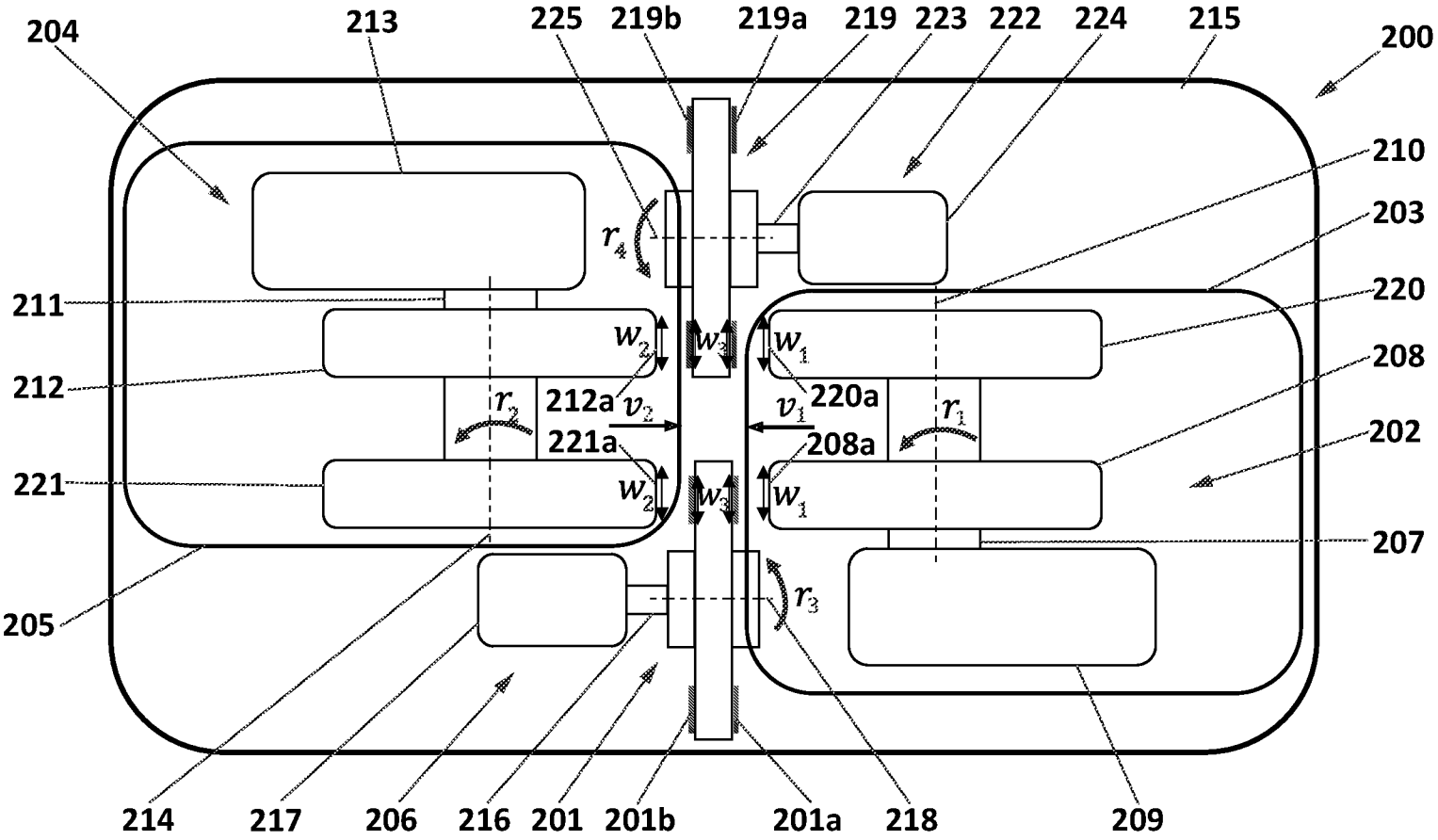
FIG. 2 shows a plant view of a machine tool for simultaneously grinding two brake discs, according to an embodiment of the invention.

FIG. 2 shows a plant view of a machine tool 200 for simultaneously grinding two brake discs 201,219, according to an embodiment of the invention. It should be understood that the machine tool 200 of FIG. 2 may include additional components and that some of the components described herein may be removed and/or modified without departing from a scope of the described machine tool 200. Additionally, implementation of the machine tool 200 is not limited to such embodiment.

The machine tool 200 of FIG. 2 is essentially the same machine tool 100 of FIG. 1 but where the first grinding spindle 207 comprises a first grinding wheel 208 and a second grinding wheel 220 arranged thereon and the second grinding spindle 211 comprises a third grinding wheel 212 and a fourth grinding wheel 221 arranged thereon, and having two brake disc units 206,221 fixedly arranged on the bench 215.

The machine tool 200 comprises a second brake disc unit 222 having a brake disc spindle 223 on which the second brake disc 219 is arranged, e.g., clamped, and a fourth motor assembly 224 for rotatably actuating the brake disc spindle 223. The brake disc spindle 223 may rotate at a fourth rotational speed $r_4$, that for example may range between 1 and 2000 revolutions per minute, around a fourth rotation axis 225. The fourth rotational speed $r_4$ may be equal or different to the third rotational speed $r_3$ of the other brake disc unit 206. The fourth motor assembly 224 may also be formed by a stepper motor, servomotor or similar, and means for attaching the second brake disc unit 222 to the bench 215. These means for attaching the brake disc unit 222 to the bench 215 may be, for example, a coupling structure that may be an integral part of the motor assembly 224 or being couplable to said motor assembly 224 and that could be welded or screwed to the bench 215. The rotation axis 218,225 of the two brake disc spindles 216,223 are substantially parallel to each other. The operation of the machine tool 200 of FIG. 2 is the same than the operation of the machine tool 100 of FIG. 1.

In this way, the first grinding wheel 208 is located in correspondence with the fourth grinding wheel 221 to simultaneously grind the first brake disc 201 and the second grinding wheel 220 is located in correspondence with the third grinding wheel 212 to simultaneously grind the braking surfaces 201*a-b*,219*a-b* of the first and second brake discs 201,219, respectively. This architecture allows grinding two brake discs at the same time increasing the productivity rate of the machine tool 200.

While the machine tool 200 of FIG. 2 shows the two brake discs 201,219 having the same width $w_3$, and thus, the four grinding wheels have also the same widths, the two brake discs 201,219 may have different widths and thus, the pairs of grinding wheels 208,221 and grinding wheels 212,220 may have a different width, each of these widths being adapted to grind the corresponding brake disc.

Figure 3:
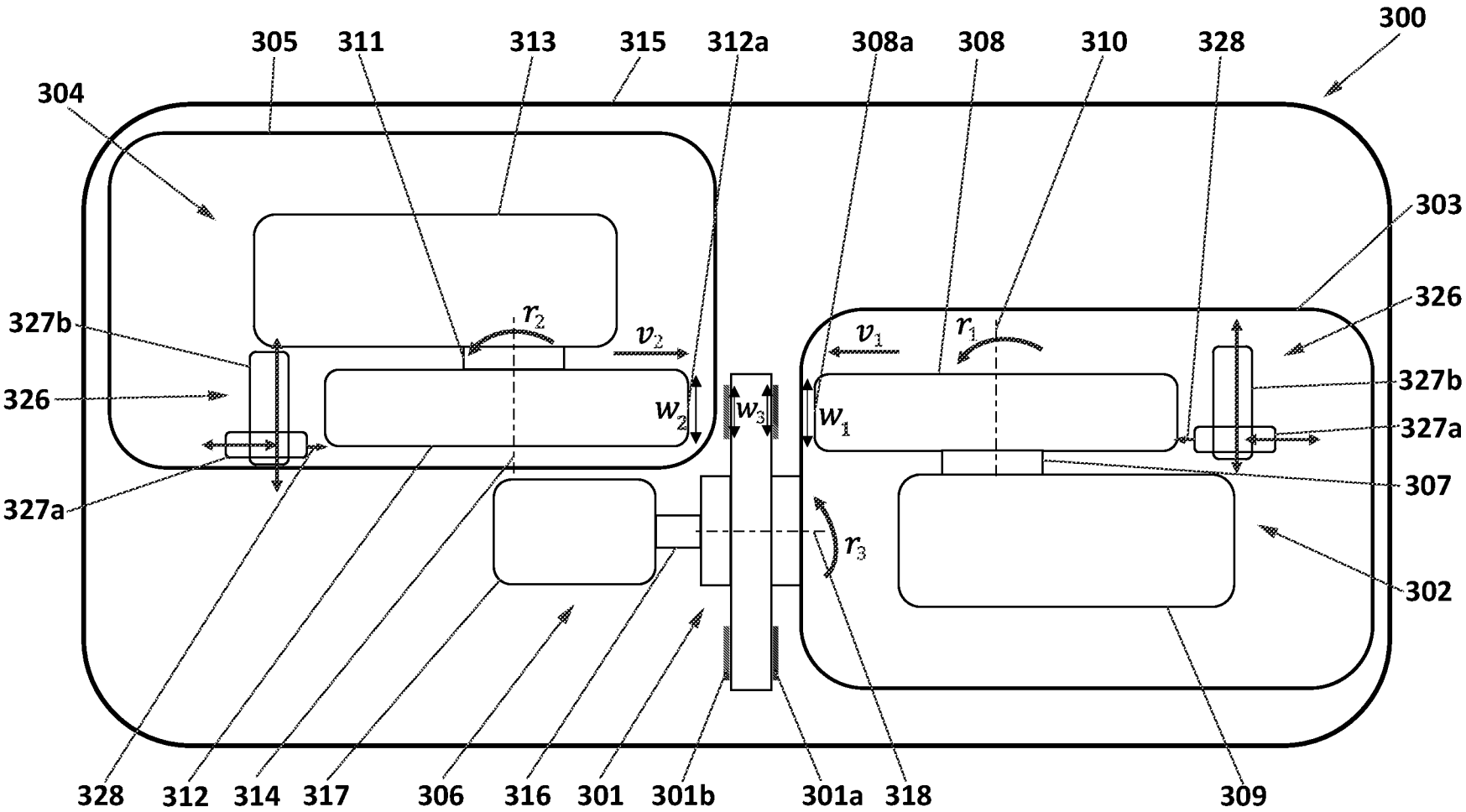
FIG. 3 shows a plant view of a machine tool for grinding a brake disc including a diamond dresser for dressing each grinding wheel, according to an embodiment of the invention.

FIG. 3 shows a plant view of a machine tool 300 for grinding a brake disc 301 including a diamond dresser 326 for dressing each grinding wheel 308,312, according to an embodiment of the invention. It should be understood that the machine tool 300 of FIG. 3 may include additional components and that some of the components described herein may be removed and/or modified without departing from a scope of the described machine tool 300. Additionally, implementation of the machine tool 300 is not limited to such embodiment.

The machine tool 300 of FIG. 3 is essentially the same machine tool 100 of FIG. 1 but including the diamond dressers 326 for dressing the grinding surfaces 308*a*,312*a* of the grinding wheels 308,312. The dressing operation is carried out by the diamond dressers 326 when the grinding units 302,304 are in their inoperative position. The diamond dressers 326 are mounted on corresponding platforms 327*a-b* which are actuated by respective servomotors (not shown in this figure) to move the diamond dressers 326 from an inoperative position in which the diamond dressers 326 do not contact the grinding surfaces 308*a*,312*a* and they are positioned far away from the grinding wheels 308,312 and an operative position in which the diamond dressers 326 contact the grinding surfaces 308*a*,312*a* to dress them. Specifically, each diamond dresser 326 comprises a first platform 327*a* configured to move the diamond dressers 326 in a direction that is perpendicular to rotation axes 310,314 of the grinding spindles 307,311 and a second platform 327*b* to move the diamond dressers 326 in a direction that is parallel to rotation axes 310,314 of the grinding spindles 307,311.

In such embodiments, the diamond dressers 326 are mounted on the platforms 303,305 and are located in correspondence with a plane formed by both grinding wheels rotational axes and behind the grinding wheels 308,312. Moreover, the diamond dresser comprises a diamond 328 to dress the grinding surfaces 308*a*,312*a* of the grinding wheels 308,312.

The platforms 327*a* are configured to, once the grinding wheels 308,312 are in their inoperative position, move the diamond dresser 326 in a direction that is perpendicular to rotation axes 310,314 of the grinding spindles 307,311 until the diamond 328 contacts the grinding surfaces 308*a*,312*a* of the grinding wheel 308,312. Then, the platforms 327*b* are configured to move the diamond dresser 326 in a direction that is parallel to rotation axes 310,314 of the grinding spindles 307,311 along the entire width of these grinding surfaces 308*a*,312*a* to dress them. Alternatively, this dressing operation may be carried out by the diamond dressers 326 during the grinding operation of the grinding wheels 308,312, i.e., when they are in their operative position.

Figure 4:
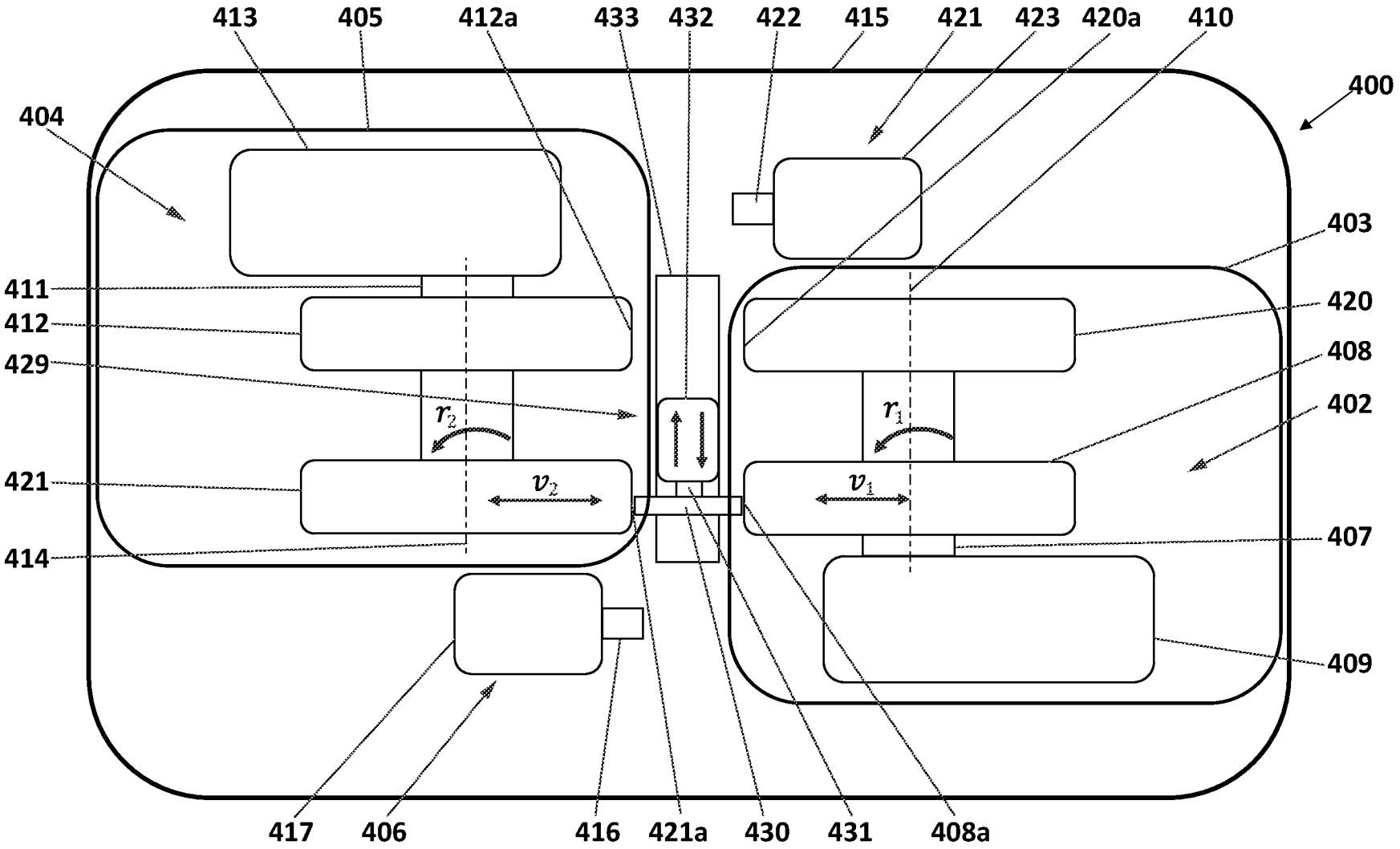
FIG. 4 shows a plant view of a machine tool for grinding two brake discs including one single diamond dresser, according to an embodiment of the invention

FIG. 4 shows a plant view of a machine tool 400 for grinding two brake discs (not shown in this figure) including one single diamond dresser 429, according to an embodiment of the invention. It should be understood that the machine tool 400 of FIG. 4 may include additional components and that some of the components described herein may be removed and/or modified without departing from a scope of the described machine tool 400. Additionally, implementation of the machine tool 400 is not limited to such embodiment.

The diamond dresser 429 comprises a diamond dressing disc 430 mounted on a dressing spindle 431 that is actuated by a servomotor 432 and it is mounted on a platform 433 that is configured to move in a direction that is substantially parallel to the rotation axes 410,414 of the grinding spindles 407,411.

In such embodiment, the two grinding units 402,404 move to a dressing position that is generally located at an intermediate point between their operative and inoperative positions. When the two grinding units 402,404 are positioned in their dressing position, the distance between the two closest points of their grinding surfaces is substantially equal to the diameter of the diamond dressing disc 430. Then, the diamond dresser 429 is configured to move in a direction that is substantially parallel to the rotation axes 410,414 of the grinding spindles 407,411 until it contacts the grinding surfaces 420*a*,412*a* of the grinding wheels 420,412 and continuous with the movement along the entire width of the surfaces 420*a*,412*a* until said grinding surfaces 420*a*, 412*a* have been completely dressed. After that, the diamond dresser 429 is configured to carried out the same operation for dressing the surfaces 408*a*,421*a* of the grinding wheels 408,421.

The architecture and disposition of the diamond dressers of FIGS. 3 and 4 is interchangeable. That is to say, the machine tool 300 of FIG. 3 may incorporate one single dresser placed between both grinding units and being movable in a direction that is substantially parallel to the rotation axes of the grinding spindles and the machine tool 400 of FIG. 4 may comprise one dresser for each one of the grinding wheels as in FIG. 3. Besides, the dressers shown in FIGS. 3 and 4 may be stationary dressers or rotary dressers with dressing tools made of different abrasive materials.

The invention claimed is:

1. A machine tool for grinding discs, comprising:

a first grinding unit comprising a first grinding spindle comprising first and second grinding wheels arranged thereon and a first motor assembly to rotatably actuate the first grinding spindle;

a second grinding unit comprising a second grinding spindle comprising first and second grinding wheels arranged thereon and a second motor assembly to rotatably actuate the second grinding spindle;

a first disc unit comprising a first disc spindle on which a first disc to be grinded is to be arranged and a third motor assembly for rotatably actuating the first disc spindle;

a second disc unit comprising a second disc spindle on which a second disc to be grinded is to be arranged and a fourth motor assembly for rotatably actuating the second disc spindle;

wherein the first grinding wheel of the first grinding unit is located in correspondence with the first grinding wheel of the second grinding unit to simultaneously grind the first disc and the second grinding wheel of the first grinding unit is located in correspondence with the second grinding wheel of the second grinding unit to simultaneously grind the second disc;

wherein the rotation axes of the first and second grinding spindles are perpendicular to a rotation axis of the first and second disc spindles;

wherein the grinding wheels comprise respective grinding surfaces, said grinding surfaces being substantially perpendicular to the rotation axis of the first and second disc spindles and having a width (w1, w2) that is equal or greater than a width (w3) of the surface of the discs to be grinded, the width (w3) of the surface of the discs to be grinded being measured in a radial direction of the discs; and wherein the first grinding unit and the second grinding unit are configured to simultaneously move relative to the first and second disc units in an axis that is parallel to the rotation axis of the first and second disc spindles and in opposite directions such that, in use, the grinding surfaces of the grinding wheels are configured to simultaneously contact opposite surfaces of the discs along the entire width (ws) of the surfaces of the discs to be grinded.

2. The machine tool according to claim 1, wherein the first grinding unit is mounted on a first platform and the second grinding unit is mounted on a second platform, the first and second platforms comprising means for moving the platforms relative to the first and second disc units in an axis that is parallel to the rotation axis of the first and second disc spindles and in opposite directions, respectively.

3. The machine tool according to claim 2, wherein the first platform and the second platform comprise respective spindles actuated by motors to move the platforms relative to the first and second disc units.

4. The machine tool according to claim 2, wherein the first and second disc units are fixedly mounted on a bench and the first and second platforms are movably mounted on the same bench.

5. The machine tool according to claim 1, wherein the first grinding spindle and the second grinding spindle are configured to rotate in the same direction or in opposite directions.

6. The machine tool according to claim 1, wherein the grinding spindles are cantilevered grinding spindles or twin-grip grinding spindles.

7. The machine tool according to claim 1, wherein the discs to be grinded are selected from a group comprising brake discs, circular knives and circular rotary blades.

8. The machine tool according to claim 1, wherein the first grinding unit comprises a first dresser comprising a first dressing tool that is configured to dress the first grinding wheel and the second grinding unit comprises a second dresser comprising a second dressing tool that is configured to dress the second grinding wheel.

9. The machine tool according to claim 8, wherein the dressers comprise:

first means for moving the dressing tool in a direction perpendicular to the rotation axis of the grinding spindles and towards the grinding surfaces of the grinding wheels; and second means for moving, the dressing tool in a direction parallel to the rotation axis of the grinding spindles and along the width ($w_3$) of the grinding wheels, the width ($w_3$) of the grinding wheel being measured in a direction parallel to the rotation axis of the grinding spindles on the grinding surfaces.

10. The machine tool according to claim 8, wherein the dressers are stationary dressers or rotary dressers.

11. The machine tool according to claim 1, comprising a dresser with a dressing disc located between the first and second grinding units, the dresser being movable in a direction parallel to the rotation axis of the grinding spindles such that a dressing surface of the dressing disc simultaneously contacts the grinding surfaces of the pairs of grinding wheels of the first and second grinding units located in correspondence, the dresser being configured to dress the grinding surfaces when the grinding wheels do not contact the discs.

12. A method for grinding discs with the machine tool according to claim 1, the method comprising the steps of:

arranging a first disc to be grinded in the first disc spindle of the first disc unit;

arranging a second disc to be grinded in the second disc spindle of the second disc unit;

actuating the disc spindles of the disc units by the respective motor assemblies;

actuating the first grinding unit and the second grinding unit such that the first grinding wheel of the first grinding unit is located in correspondence with the first grinding wheel of the second grinding unit and the second grinding wheel of the first grinding unit is located in correspondence with the second grinding wheel of the second grinding unit;

simultaneously moving the first grinding unit and the second grinding unit in an axis that is parallel to the rotation axes of the disc spindles and in opposite directions towards the discs until the grinding surfaces of the grinding wheels simultaneously contact opposite surfaces of the discs along the entire width of the surfaces of the discs;

simultaneously grinding both surfaces of the discs by the grinding wheels of the first and second grinding units during a predefined period of time;

simultaneously retracting the first and second grinding units; and removing the discs from the disc spindles of the disc units.

13. The method of claim 12, comprising:

actuating at least one of the first dressing tool and the second dressing tool of the first and second dressers, respectively;

moving, by the first means, the corresponding dressing tool in a direction perpendicular to the rotation axis of the respective grinding spindles until a dressing surface of the dressing tool contacts the grinding surface of the grinding wheel; and moving, by the second means, the dressing tool in a direction parallel to the rotation axis of the grinding spindle and along the width ($w_1$,$w_2$) of the grinding wheel to dress its grinding surface, the width ($w_1$,$w_2$) of the grinding wheel being measured in a direction parallel to the rotation axis of the grinding spindle on the grinding surface.

14. The machine tool according to claim 2, wherein the grinding spindles are cantilevered grinding spindles or twin-grip grinding spindles.

15. The machine tool according to claim 3, wherein the grinding spindles are cantilevered grinding spindles or twin-grip grinding spindles.

16. The machine tool according to claim 4, wherein the grinding spindles are cantilevered grinding spindles or twin-grip grinding spindles.

17. The machine tool according to claim 5, wherein the grinding spindles are cantilevered grinding spindles or twin-grip grinding spindles.

18. The machine tool according to claim 2, wherein the disc to be grinded is selected from a group comprising brake discs, circular knives and circular rotary blades.

* * * * *